US005267808A

United States Patent [19]

Welford

[11] Patent Number: 5,267,808

[45] Date of Patent: Dec. 7, 1993

[54] ELECTRONICALLY CONTROLLED SPEED BUMP DEVICE

[76] Inventor: Jay L. Welford, 30896 Huntsman Dr. E., Farmington Hills, Mich. 48331

[21] Appl. No.: 796,133

[22] Filed: Nov. 21, 1991

[51] Int. Cl.[5] ..... E01F 9/00; E01C 19/00

[52] U.S. Cl. ..... 404/11; 404/84.05

[58] Field of Search ..... 404/6, 9-11, 404/84.05; 256/1, 13.1; 244/110 C-110 F; 435/808; 362/153.1

[56] References Cited

U.S. PATENT DOCUMENTS

| | | | |
|---|---|---|---|
| Re. 33,201 | 4/1990 | Dickinson | 404/6 |
| 4,012,156 | 3/1977 | Turner et al. | 404/15 |
| 4,342,525 | 8/1982 | Mastronuzzi, Jr. | 404/6 |
| 4,362,424 | 12/1982 | Barber | 404/6 |
| 4,490,068 | 12/1984 | Dickinson | 404/6 |
| 4,576,507 | 3/1986 | Terio | 404/6 |
| 4,576,508 | 3/1986 | Dickinson | 404/6 |
| 4,715,742 | 12/1987 | Dickinson | 404/6 |
| 4,818,136 | 4/1989 | Nasatka et al. | 404/6 |
| 4,893,119 | 1/1990 | Nasatka | 404/6 X |
| 4,974,991 | 12/1990 | Mandavi | 404/6 |

*Primary Examiner*—Kenneth J. Dorner
*Assistant Examiner*—Nancy P. Connolly

[57] ABSTRACT

A selectively retractable and extendable electronically controlled vehicle speed bump mounted in a street, road or roadway for controlling the speed of vehicles includes a sensor for detecting or sensing vehicle speed, a microprocessor responsive to the sensor for generating a signal to activate the speed bump, and an actuator for extending and retracting the speed bump.

20 Claims, 1 Drawing Sheet

ELECTRONICALLY CONTROLLED SPEED BUMP DEVICE

BACKGROUND OF THE INVENTION

The present invention generally relates to vehicle or traffic speed controls and more particularly to an improved speed bump device.

Speed bumps are frequently embedded in roadways, such as in access lanes to and from residential and school areas, parking lots and the like so as to discourage or prevent the use of vehicles at high speed. Most such speed bumps are merely spaced rubber, steel, asphalt or concrete bars or the like placed on the road surface and, accordingly, are subject to wear. Moreover, they do not retract, so that even slow moving vehicles are jolted by passing over the bumps.

Certain other speed bumps have been devised which have bumps that can be retracted or raised, as needed, either by a tool or by a remotely operated hydraulic ram. Another mechanism, which is disclosed by U.S. Pat. No. 4,974,991, is a speed bump which automatically lowers when contacted by a vehicle wheel traveling at a lower than prescribed speed. Unfortunately, the design disclosed by the '991 patent for the automatic speed bump requires the presence of a rectangular hole in the roadway. While such a hole would generally not be a hazard to most automobiles, it could pose a significant hazard to others who use roadways, i.e., pedestrians and bicyclists. In addition, such a depression in a roadway will necessarily collect debris and standing water which would likely challenge the mechanical integrity of the automatic speed bump. Accordingly, there remains a need for an improved speed bump which can selectively allow slow moving vehicles to pass thereover smoothly without a bump while causing rapidly moving vehicles to suffer a bump.

SUMMARY OF THE INVENTION

The present invention provides for a speed bump which selectively retracts and extends according to the speed of an approaching vehicle. The invention comprises an electronically controlled vehicle speed bump device which has a sensing device for sensing vehicle speed, a control device responsive to the sensing device for generating a signal, and a speed bump device responsive to said signal, said speed bump having retracted and extended positions.

Further features of the speed bump of the present invention are set forth in the following detailed description and accompanying drawings.

DETAILED DESCRIPTION OF THE PREFERRED EMBODIMENT

Figure 1:
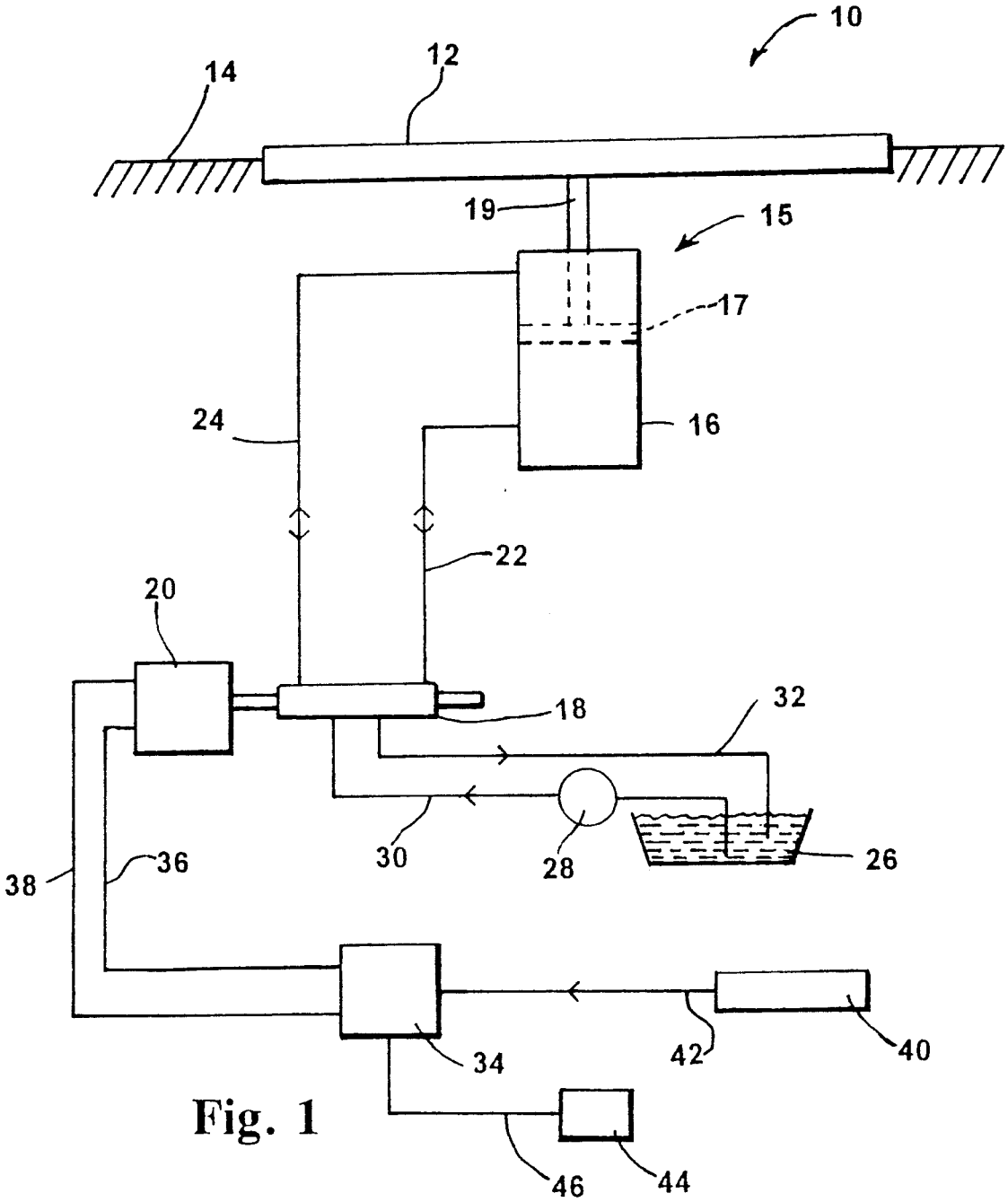
FIG. 1 is a schematic diagram of the electronically controlled speed bump of the present invention.

Generally, the electronically controlled vehicle speed bump device of the present invention includes a sensing device for detecting or sensing vehicle speed, a control device responsive to the sensing device for generating a signal and a speed bump device responsive to the signal, the speed bump having retracted and extended positions.

A variety of sensing devices are available for use in the present invention. For example, the sensing device may have a transmitter for emitting a sensor signal to detect a moving vehicle and a receiver for receiving the signal reflected from the vehicle. Examples of this type of sensing device are those which utilize electromagnetic energy or waves, i.e., infrared or microwave energy, or Doppler shift radar. Other types of sensing devices may have a first sensor for generating a first signal, a second sensor for generating a second signal and a timing means responsive to these signals. Here, the first and second sensors are spaced a predetermined distance from each other. The control device contains a timing device responsive to the first and second signals and calculates vehicle speed from that time information. Examples of this type of sensing device are photo-optic devices which direct a light beam across a road to a receiver or a series of pneumatically operated compression tubes extended across the vehicular path where the pneumatic device is responsive to the presence or passage of a vehicle.

Generally, regardless of sensing device utilized, the present invention utilizes a microprocessor as the control device. Upon detection of the presence or passage of a vehicle exceeding a prescribed speed limit, the microprocessor of the present invention will translate this detection of a vehicle into a signal which activates and extends the speed bump. Retraction of the speed bump can be controlled by the passage of time, i.e., the bump is extended for a set period of time, or by the placement of a sensor beyond the speed bump which detects the passage of the vehicle and generates a retraction signal.

FIG. 1 illustrates the electronically controlled speed bump device of the present invention which is generally designated by reference numeral 10. Device 10 includes a speed bump 12 located in a street 14. While bump 12 is depicted in FIG. 1 as a solid bar, it is contemplated that a wide variety of designs may be suitable for bump 12, among them being bump 12 as a bar having prongs or "teeth".

Bump 12 is extended and retracted by a double acting piston/cylinder actuator 15, having a hydraulic cylinder 16 containing a piston 17 and a rod 19. Movement of piston 17 is controlled by a hydraulic control valve 18, which is activated by a solenoid 20. Valve 18 communicates with cylinder 16 by means of a first fluid line 22 and a second fluid line 24. Valve 18 is connected to a fluid source including a fluid reservoir 26 and a pump 28 by a valve intake line 30. A valve drain line 32 also connects valve 18 to reservoir 26. A controller 34 actuates solenoid 20 by means of a raise signal line 36 and lower signal line 38. Controller 34, in turn, is actuated by sensing device 40 connected to controller 34 by a contact line 42. Optionally, a warning indicator 44 could then be actuated by controller 34 by an activation line 46.

In a preferred embodiment, the only portion of device 10 which would be underground is actuator 15, first fluid line 22 and second fluid line 24. The remaining components of device 10 could be located beside street 14 to facilitate maintenance and repair. Also in a preferred embodiment, the warning indicator could be a flashing light, a sign, or some form of audible signal.

In operation, sensing device 40 detects a moving vehicle and sends a signal to controller 34 via contact line 42 for analysis. Controller 34 includes a microprocessor which compares the moving vehicle speed to a set or predetermined speed. If the vehicle speed exceeds the set speed, controller 34 will send a raise signal through raise signal line 36 to solenoid 20 and a actuation signal through activation line 46 to warning indicator 44. Solenoid 20 then activates control valve 18 which connects fluid line 22 to the pump 28 and line 24 to reservoir 26. Line 24 acts as a drain line allowing fluid above piston 17 to drain to the reservoir through line 32. Actuator 15, therefore, extends bar 12 above street 14. Bar 12 is now in a position to provide a significant jolt to any vehicle traveling over it at a excessive speed and warning indicator 44 is in a position to advise the operator of the speeding vehicle of the impending jolt.

The controller 34 is programmed to retract the speed bump and the warning indicator 44 after a specified period of time. Therefore, the vehicle which activates the speed bump 10 can avoid contact with bar 12 by diminishing its speed sufficiently to allow bar 12 sufficient time to be retracted. The time of extension of bar 12 is calculated based on the speed of the activating vehicle and the distance the vehicle is from bar 12 at the point of detection. The time calculated by the processor will be sufficient to allow contact between the vehicle and bar 12 if the vehicle does not slow down to the point where its average velocity between the point of detection and the bar 12 equals the prescribed velocity.

This selective control of speed bump 10 limits the wear and tear on the speed bump 10 caused by contact with vehicles. Contact is made only with those vehicles which are exceeding the prescribed speed limit and which fail to slow down sufficiently following detection for exceeding the prescribed speed limit. After passage of the predetermined period of time controller 34 actuates solenoid 20 to reposition valve 18. Line 24 is connected to pump 28 and line 22 is connected to the reservoir through line 32 to retract rod 19 and hence lower bump 12. The double-acting piston cylinder actuator as shown in FIG. 1 facilitates the quick response of the device 10 to the passage of vehicles. In the alternative, a single acting piston/cylinder could be used. It is also contemplated that the speed bump 12 could be actuated by pneumatic rather than hydraulic devices.

It is contemplated that this controlled amount of contact with vehicles will extend the useful life of the speed bump. Should a part of the speed bump device 10 fail, however, it would be advantageous to have the bar 12 of the speed bump 10 fail to the extended position. This would allow easy diagnosis of the failure and would also ensure that vehicle speeding would continue to be discouraged.

It is further contemplated that speed bump 10 would be constructed on a single side of a roadway. Thus, speed control could be achieved on a lane by lane basis. The hazard of having a single speed bump 10 cover a bidirectional roadway is obvious: a vehicle speeding on one side of the road could activate the bar 12 which would arise suddenly in front of a law abiding driver coming from the opposite direction.

The above description is considered that of the preferred embodiment only. Modifications of the invention may occur to those of ordinary skill in the art. Therefore, it is understood that the embodiment shown in the drawings and described above is merely for illustrative purposes and is not intended to limit the scope of the invention, which is defined by the following claims as interpreted according to the principles of patent law.

I claim:

1. An electronically controlled vehicle speed bump device comprising:

sensing means for sensing vehicle speed and generating an output signal;

control means connected to said sensing means responsive to said sensing means output signal for generating an actuating signal;

timing means connected to said sensing means responsive to said sensing means output signal for generating a retraction signal after said generation of said actuating signal;

speed bump means connected to said control means and said timing means and having a speed bump, said speed bump means being responsive to said actuating signal for moving said speed bump from a retracted to an extended position, said speed bump means further being responsive to said retraction signal for moving said speed bump from an extended to a retracted position, said speed bump being a bump positioned on a road surface which causes moving vehicles to suffer a jolt when passing over said speed bump in said extended position.

2. An electronically controlled vehicle speed bump device comprising:

sensing means for sensing vehicle speed and generating an output signal;

control means connected to said sensing means responsive to said sensing means output signal for generating an actuating signal;

speed bump means connected to said control means and having a speed bump, said speed bump means being responsive to said actuating signal for moving said speed bump between retracted and extended positions;

said sensing means having a transmitter for emitting a sensor signal directed towards a moving vehicle and a receiver for receiving said signal reflected from the vehicle.

3. The device defined by claim 2 wherein said sensor signal utilizes electromagnetic energy.

4. An electronically controlled vehicle speed bump device comprising:

sensing means for sensing vehicle speed and generating an output signal;

control means connected to said sensing means responsive to said sensing means output signal for generating an actuating signal;

speed bump means connected to said control means and having a speed bump, said speed bump means being responsive to said actuating signal for moving said speed bump between retracted and extended positions;

said sensing means having a first sensor for generating a first signal upon detecting a moving vehicle, a second sensor for generating a second signal upon detecting said moving vehicle, and a timing means responsive to said first and second signals.

5. The device defined by claim 4 wherein said first and second sensors are photo-optic devices.

6. The device defined by claim 4 wherein said first and second sensors are pneumatically operated compression tubes.

7. The device defined by claim 1 wherein said control means is a microprocessor.

8. An electronically controlled vehicle speed bump device comprising:

sensing means for sensing vehicle speed and generating an output signal;

control means connected to said sensing means responsive to said sensing means output signal for generating an actuating signal;

speed bump means connected to said control means and having a speed bump, said speed bump means being responsive to said actuating signal for moving said speed bump between retracted and extended positions;

said control means being a microprocessor; and said sensing means having a transmitter for emitting a sensor signal directed towards a moving vehicle and a receiver for receiving said signal reflected from the vehicle.

9. The device defined by claim 8 wherein said sensor signal utilizes electromagnetic energy.

10. An electronically controlled vehicle speed bump device comprising:

sensing means for sensing vehicle speed and generating an output signal;

control means connected to said sensing means responsive to said sensing means output signal for generating an actuating signal;

speed bump means connected to said control means and having a speed bump, said speed bump means being responsive to said actuating signal for moving said speed bump between retracted and extended positions;

said control means being a microprocessor; and said sensing means having a first sensor for generating a first signal upon detecting a moving vehicle, a second sensor for generating a second signal upon detecting said moving vehicle, and a timing means responsive to said first and second signals.

11. The device defined by claim 10 wherein said first and second sensors are photo-optic devices.

12. The device defined by claim 10 wherein said first and second sensors are pneumatically operated compression tubes.

13. An electronically controlled vehicle speed bump device comprising:

sensing means for sensing vehicle speed and generating an output signal;

control means connected to said sensing means responsive to said sensing means output signal for generating an actuating signal;

speed bump means connected to said control means and having a speed bump, said speed bump means being responsive to said actuating signal for moving said speed bump between retracted and extended positions;

said speed bump means being a hydraulically activated speed bump.

14. The device defined by claim 13 wherein said control means is a microprocessor.

15. The device defined by claim 14 wherein said sensing means has a transmitter for emitting a sensor signal directed towards a moving vehicle and a receiver for receiving said signal reflected from the vehicle.

16. The device defined by claim 15 wherein said sensor signal utilizes electromagnetic energy.

17. The device defined by claim 14 wherein said sensing means has a first sensor for generating a first signal upon detecting a moving vehicle, a second sensor for generating a second signal upon detecting said moving vehicle, and a timing means responsive to said first and second signals.

18. The device defined by claim 17 wherein said first and second sensors are photo-optic devices.

19. The device defined by claim 17 wherein said first and second sensors are pneumatically operated compression tubes.

20. The device defined by claim 1 further comprising a warning indicator connected to said control means responsive to said actuating signal.

* * * * *